US005184998A

United States Patent [19]

Volk et al.

[11] Patent Number: 5,184,998

[45] Date of Patent: Feb. 9, 1993

[54] CORRUGATED CARDBOARD OR CHIPBOARD CARTON FORMING MACHINE

[75] Inventors: Kenneth H. Volk; Douglas A. Volk, both of Portland; Paul Voccia, Kennebunkport; William D. Lewis, Cape Eiizabeth, all of Me.

[73] Assignee: Volk Packaging Corporation, Biddeford, Me.

[21] Appl. No.: 682,427

[22] Filed: Apr. 8, 1991

[51] Int. Cl.[5] ..... B31B 1/44; B31B 1/52

[52] U.S. Cl. ..... 493/176; 493/175; 493/457; 493/476

[58] Field of Search ..... 493/175, 176, 442, 69, 493/70, 79, 80, 162, 455–457, 476

[56] References Cited

U.S. PATENT DOCUMENTS

| | | | |
|---|---|---|---|
| Re. 26,305 | 11/1967 | Huang et al. | 229/249 |
| 2,837,013 | 6/1958 | Pagendarm | 493/175 X |
| 3,086,337 | 4/1963 | Engleson et al. | 493/457 X |
| 3,117,710 | 1/1964 | Beach, Jr. | 229/215 |
| 3,137,434 | 6/1964 | Berg | 229/175 |
| 3,185,374 | 5/1965 | Feeney | 229/120 |
| 3,187,980 | 6/1965 | Oas et al. | 229/198 |
| 3,189,248 | 6/1965 | Roccaforte | 229/172 |
| 3,236,433 | 2/1966 | Barrett et al. | 229/120.28 |
| 3,246,829 | 4/1966 | Sexton | 229/228 |
| 3,294,226 | 12/1966 | McFarland et al. | 206/418 |
| 3,513,757 | 5/1970 | Frank | 493/175 X |
| 3,572,689 | 3/1971 | Murphy et al. | 493/423 |
| 3,797,371 | 3/1974 | Randle | 493/295 |
| 3,834,689 | 9/1974 | Lee et al. | 270/41 |
| 3,841,620 | 10/1974 | Lee et al. | 270/40 |
| 3,845,948 | 11/1974 | Furbeck et al. | 270/40 |
| 3,904,106 | 9/1975 | Elder | 229/149 |
| 3,956,874 | 5/1976 | Vickers et al. | 53/207 |
| 3,965,804 | 6/1976 | Elford | 493/168 |
| 3,982,474 | 9/1976 | Klund | 493/18 |
| 3,991,932 | 11/1976 | Curren, et al. | 229/195 |
| 4,046,001 | 9/1977 | Maeda et al. | 73/774 |
| 4,156,956 | 6/1979 | Partridge et al. | 27/4 |
| 4,159,797 | 7/1979 | Roozee | 229/120.02 |
| 4,244,282 | 1/1981 | Ruzand et al. | 493/23 |
| 4,289,268 | 9/1981 | Paige | 229/117 |
| 4,331,435 | 5/1982 | Nowacki | 493/178 |
| 4,373,660 | 2/2983 | Wytko | 229/145 |
| 4,398,902 | 8/1983 | Mangum | 493/102 |
| 4,399,915 | 8/1983 | Sorenson | 206/586 |
| 4,437,850 | 3/1984 | Ono | 493/89 |
| 4,498,895 | 2/1985 | White | 493/162 X |
| 4,562,686 | 1/1986 | Focke | 493/183 |
| 4,578,054 | 3/1986 | Herrin | 493/126 |
| 4,579,551 | 4/1986 | Ulrich et al. | 493/23 |
| 4,596,542 | 6/1986 | Moen | 493/176 X |
| 4,601,687 | 7/1986 | Gallaher | 493/89 |
| 4,604,083 | 8/1986 | Barny et al. | 493/28 |
| 4,614,511 | 9/1986 | Verhoef | 493/125 |
| 4,614,512 | 9/1986 | Capdeboseq | 493/441 |
| 4,674,998 | 6/1987 | Benedicenti | 493/476 X |
| 4,826,714 | 5/1989 | King | 428/34.2 |
| 4,827,690 | 5/1989 | Niger | 52/782 |
| 4,834,696 | 5/1989 | Marschke | 493/179 |
| 4,836,418 | 6/1989 | Dinslage | 222/82 |
| 4,892,513 | 1/1990 | Kwiek | 493/316 |
| 4,926,615 | 5/1990 | Alexander | 53/564 |

*Primary Examiner*—Bruce M. Kisliuk
*Assistant Examiner*—John A. Marlott
*Attorney, Agent, or Firm*—Weingarten, Schurgin, Gagnebin & Hayes

[57] ABSTRACT

A corrugated cardboard or chipboard carton forming machine including a first portion having four corner defining members which are adjustable to define the base of a carton to be constructed. The corrugated cardboard or chipboard carton forming machine also includes a fold generating portion having four adjustable fold generting members, each of which is adapted to pass over the corresponding corner defining member so as to fold a corrugated cardboard or chipboard blank, positioned on the first portion, over the corner defining members to thereby define the sides of the carton to be constructed.

3 Claims, 4 Drawing Sheets

CORRUGATED CARDBOARD OR CHIPBOARD CARTON FORMING MACHINE

FIELD OF THE INVENTION

This invention relates to the field of machines for fabricating corrugated cardboard or chipboard cartons.

BACKGROUND OF THE INVENTION

Corrugated cardboard or chipboard cartons are used frequently for the shipment or storage of goods. Many times, the shipment or storage of goods requires the use of heavy corrugated cardboard stock in fabricating the cartons. Triple wall corrugated cardboard used in the construction of very sturdy cartons is difficult to fold and hence cartons made from such material are difficult to fabricate. The present invention relates to a machine which utilizes a single movable unit to form cartons from corrugated cardboard, including multiple wall or chipboard stock.

SUMMARY OF THE INVENTION

The corrugated cardboard or chipboard carton forming machine disclosed herein includes a first portion having four corner defining members which are adjustable to define the base of a carton to be constructed. A fold generating portion has four adjustable fold generating members, each of which is adapted to pass over the corner defining members so as to fold a corrugated cardboard or chipboard blank, positioned on the first portion, over the corner defining members to thereby define the sides of the carton to be constructed.

BRIEF DESCRIPTION OF THE DRAWINGS

These and other advantages of the invention will be understood with reference to the appended specification and drawings of which.

DESCRIPTION OF THE PREFERRED EMBODIMENT

Figure 1:
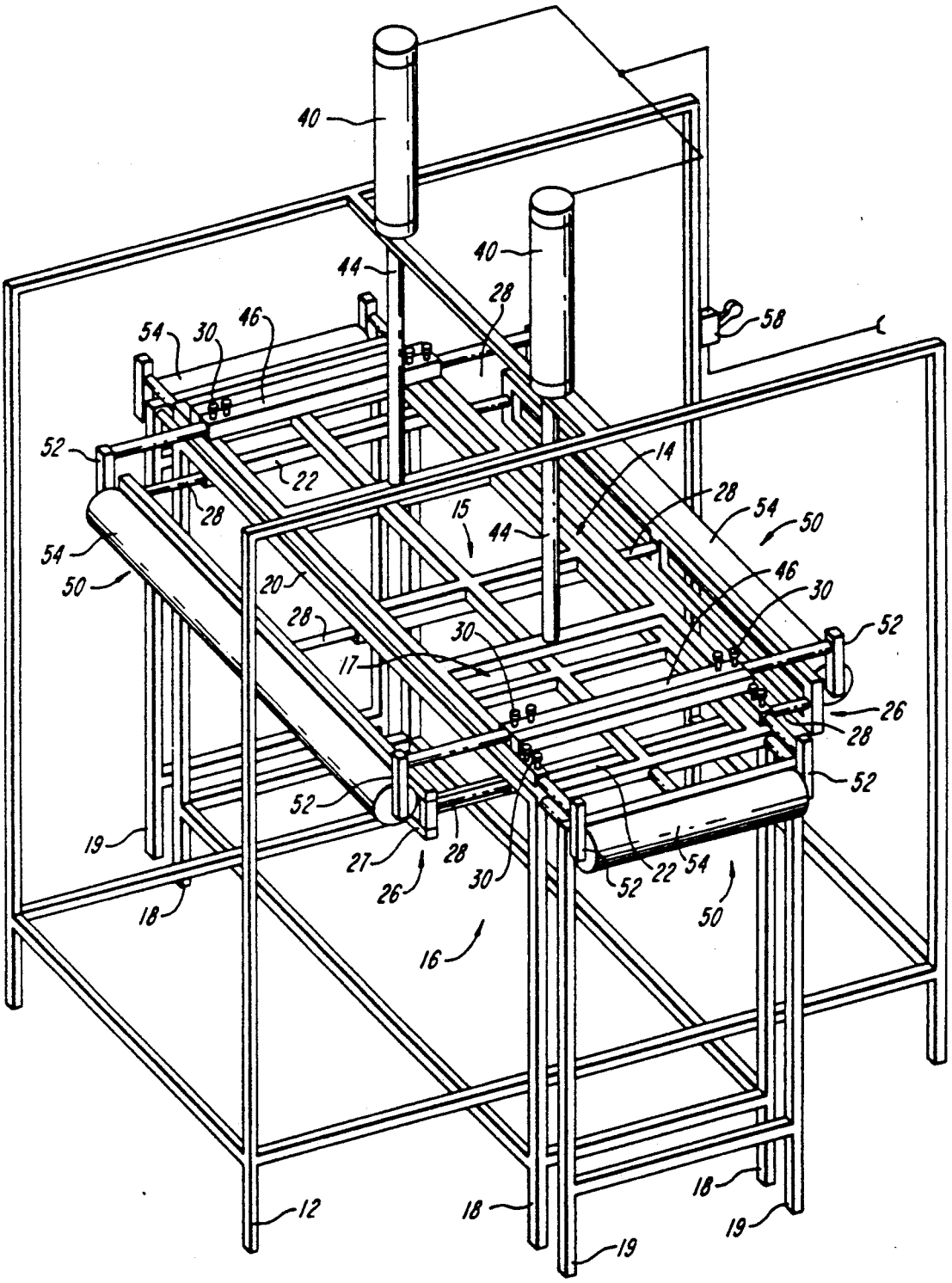
FIG. 1 is a perspective view of an embodiment of the invention.
Figure 2:
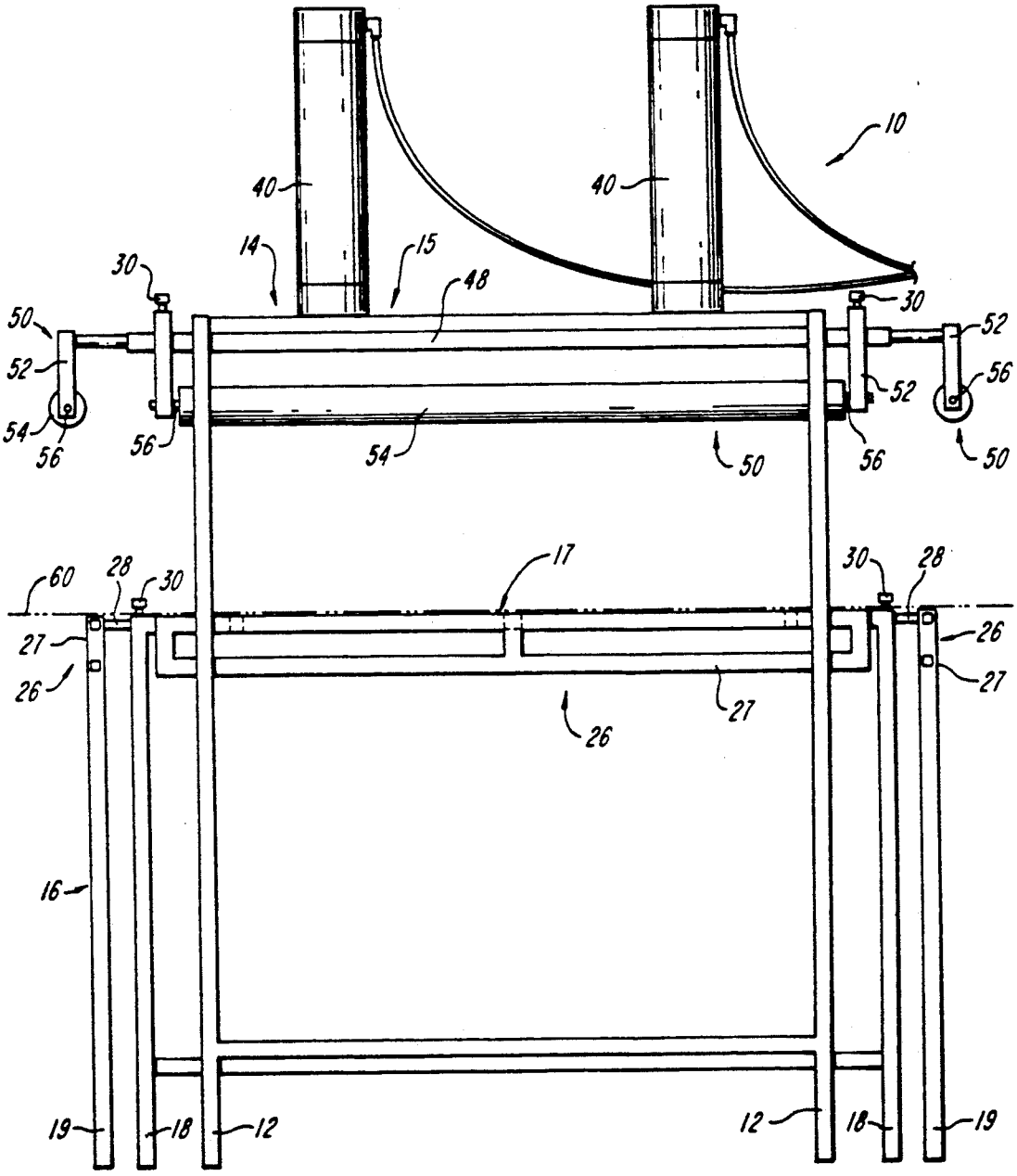
FIG. 2 is a side view of the embodiment of the invention shown in FIG. 1 in the loading position.

An embodiment of a corrugated cardboard or chipboard carton forming machine 10, shown in FIGS. 1 and 2, includes a support frame 12, a movable portion 14 and a stationary portion 16. The stationary portion 16 includes a stationary, substantially horizontal, rectangular platform 17 supported by four legs 18. The stationary platform 17 is constructed of a plurality of tubular members 20 arranged in a regular orthogonal array. Two additional tubular members 22 are positioned below and along two opposite edges of the stationary platform 17.

In the embodiment shown, there are four corner defining members 26, one corner defining member 26 located parallel to each side of the stationary platform 17. A plurality of horizontal support members 28 are attached to and project from one side of each corner defining member 26. The horizontal support members 28 of two oppositely facing corner defining members 26 are constructed and arranged to telescope within some of the tubular members which form the stationary platform 17 and which are oriented perpendicular to the corner defining member 26. The horizontal support members 28 of the other two oppositely facing corner defining members 26 are constructed and arranged to telescope within the additional tubular members 22 which are positioned below and adjacent the opposite edges of the stationary platform 17.

Each corner defining member 26 is maintained at a predetermined distance from the stationary platform 17 by the horizontal support members 28. The outside surfaces 27 of the corner defining members 26 thereby approximately define a rectangle which is larger than the stationary platform 17. The horizontal support members 28 are held at a predefined position within the tubular members by set screws 30. It is the area defined by the outer surfaces 27 of the corner defining members 26 which define the base of the carton to be formed by the machine.

The movable portion 14 includes a pair of pneumatic cylinders 40 supported by the support frame 12. The pistons 44 of the pneumatic cylinders 40 are attached to a movable, substantially horizontal, rectangular platform 15. The movable platform 15 is constructed of a plurality of tubular members 48 arranged in a regular orthogonal array. Two additional tubular members 46 are positioned above and along two opposite edges of the platform 15.

In the embodiment shown there are four fold generating members 50; one fold generating member 50 located parallel to each side of the movable platform 15. Each folding member 50 includes two L-shaped support members 52 and a cylinder 54 rotatably mounted on an axle 56. The L-shaped support members 52 are oriented with a horizontal upper portion and a vertical lower portion. The horizontal upper portion of each L-shaped member 52 is constructed and arranged to telescope within one of the tubular members 46,48 of the movable platform 15. The cylinder 54 and axle 56 of each fold generating member 50 is supported between the vertical portions of the L-shaped support members 52.

The ability of the horizontal portion of the L-shaped support members 52 to telescope within the tubular members 46,48 of the movable platform 15 allows the vertical portions of the support members 52 to be positioned at a predetermined distance from the movable platform 15. The horizontal upper portion of each L-shaped support member 52 is held at a predefined position within the tubular members 46,48 by set screws 30. This arrangement permits the cylinder 54 of the fold generating member 50 to project below and beyond the movable platform 15. In use, the horizontal upper portion of each pair of L-shaped members 52 is positioned to project from the movable platform 15 sufficiently to permit the cylinder 54 associated with that pair of L-shaped members 52 to pass to the outside of the outer surface 27 of the corner defining member 26 on that corresponding side of the stationary platform 17.

Figure 3:
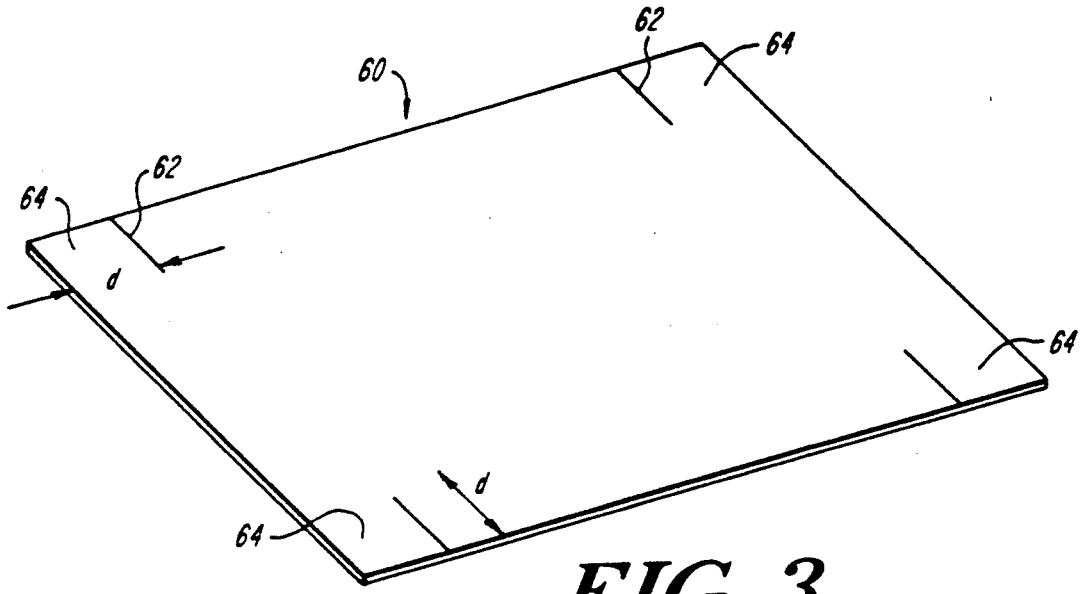
FIG. 3 is a perspective view of an embodiment of a corrugated cardboard blank for use with the invention.

The carton forming machine 10 in the loading position is shown in FIG. 2. The pistons 44 of the pneumatic cylinders 40 are retracted and the movable platform 15 is positioned at some distance above the stationary platform 17. In this position the cylinders 54 of the fold generating members 50 are also located above the plane of the stationary platform 17 and the corner defining members 26. With the machine 10 in this position, a blank 60 of corrugated cardboard or chipboard stock as shown in FIG. 3, is placed on the stationary platform 17 so as to overlap equally each corner defining member 26. The stock may be the difficult-to-fold triple wall cardboard.

The blank 60 has a slit 62 cut near each corner 64. The slit 62 is parallel to one edge of the corner 64 and is located in from the other edge of the corner 64 at a distance approximately equal to the depth (d) of the side of the carton being constructed. The length (d) of the slit 62 extends toward the center of the edge also approximately equal to the depth (d) of the side of the box being constructed.

Figure 5:
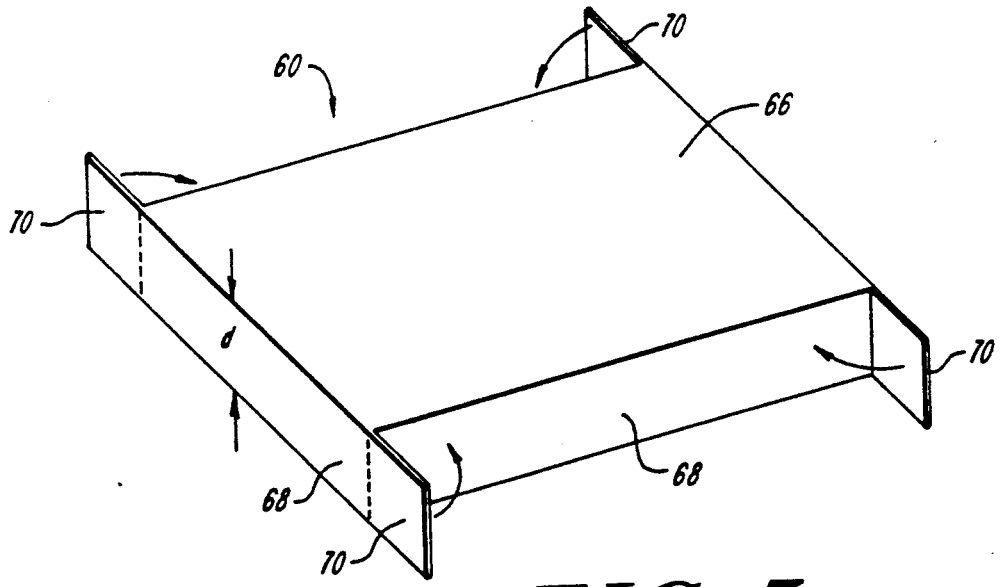
FIG. 5 is a perspective view of the embodiment of the blank in FIG. 4, in a partially folded configuration.
Figure 4:
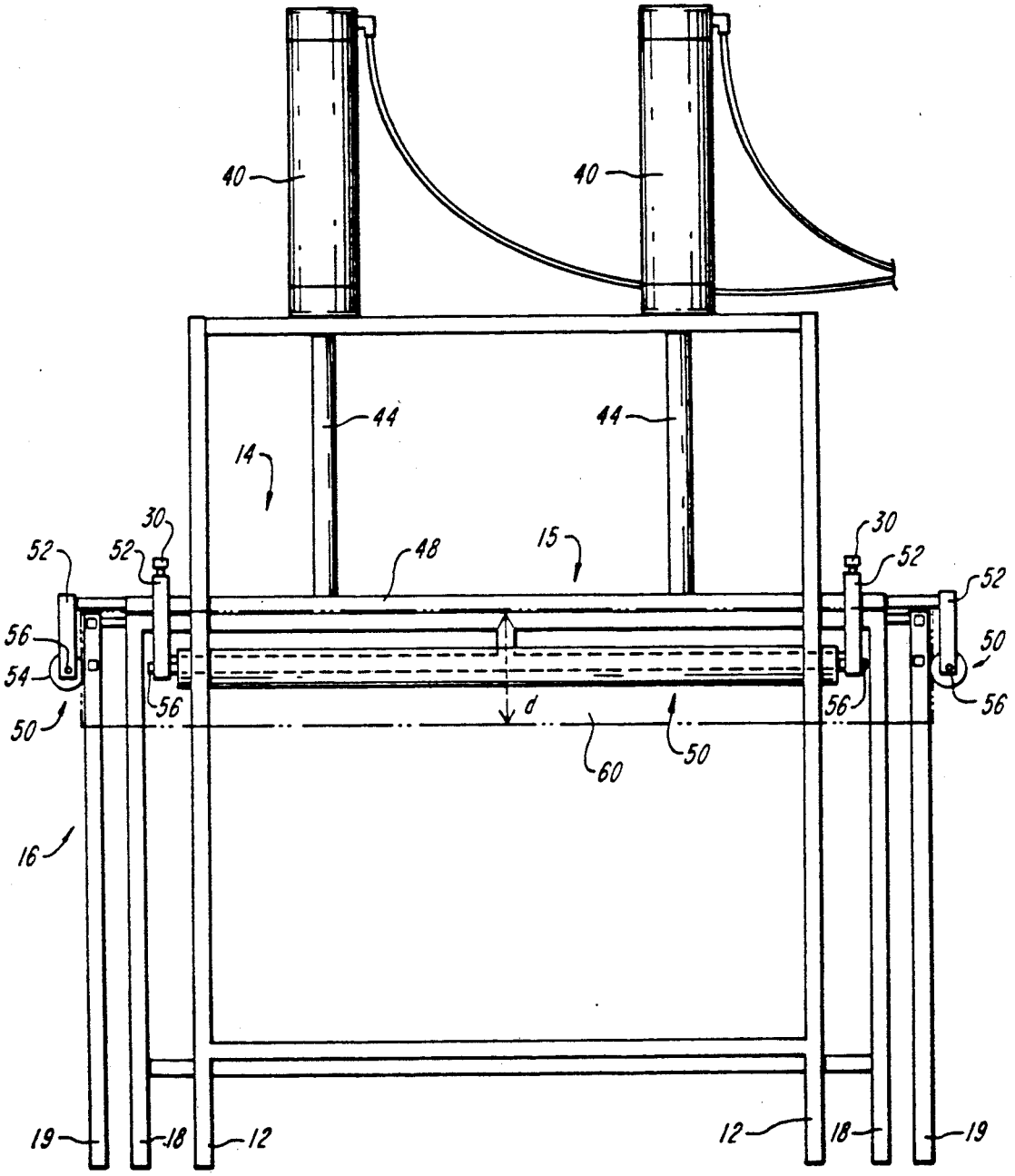
FIG. 4 is a side view of the embodiment of the invention of FIG. 1 in the folding position.

Once the blank 60 is placed on the stationary platform (17), the pneumatic cylinders 40 are pressurized by a valve controlled pressure line 58, moving the fold generating members 50 down over the corner defining members 26. Each fold generating member passes beyond its respective edge defining member at a distance sufficient to permit corrugated cardboard or chipboard to fit between the fold defining member and the fold generating member. The cardboard blank 60 is thereby folded over the corner defining member 26 by the cylinders 54 of the fold generating members 50 as is shown in FIG. 4. At this point, the blank 60 has been folded so as to define the bottom 66 and sides 68 of the carton being formed as shown in FIG. 5.

At this point the tabs 70, which are formed from folding of the sides of the carton along the slits 62, extend beyond the sides of the carton. Each tab 70 is then folded toward the adjacent side of the carton (shown by arrows) and secured in position with staples or other suitable means. Once the tabs 70 are all secured, the pneumatic cylinders 40 are depressurized and the movable platform 15 is withdrawn from the stationary platform 17, moving the fold generating members 50 away from the corner defining members 26. The completed carton is then removed from the corner defining members 26.

It should be noted, in the embodiment shown, one pair of corner defining members 26 are further supported by additional legs 19. It is possible to support all the corner defining members 26 in this manner, and thereby reduce the shearing force that is applied to the horizontal support members 28 as the fold generating members 50 apply pressure to the blank of cardboard supported on the corner defining members 26.

Other embodiments may be contemplated which are within the scope and spirit of the appended claims. It is therefore the intention to limit the scope of the invention only by the claims.

What is claimed is:

1. A triple wall corrugated cardboard carton forming machine comprising:

a first portion comprising a plurality of corner defining members, each member having a corner forming surface;

a second portion comprising a plurality of fold generating cylinders, said fold generating cylinders positionable to pass adjacent to said corner defining surface of said corner defining members at a distance sufficient to permit a thickness of triple wall corrugated cardboard to fit between each said fold generating cylinder and its respective corner defining member; and energizing means for moving said second portion and said first portion relative to each other between a first position wherein said fold generating cylinders are located outside a plane defined by said corner defining members and a second position wherein said fold generating cylinders are located adjacent to said corner forming surface of said corner defining members, said relative movement of said first portion and said second portion causing a triple wall corrugated cardboard blank placed on said first portion to be folded over said corner defining members.

2. A corrugated cardboard and chipboard carton forming machine comprising:

a first portion comprising a plurality of corner defining members, each member having a corner forming surface;

a second portion comprising a plurality of fold generating members, said fold generating members positionable to pass adjacent to said corner defining surface of said corner defining members at a distance sufficient to permit a thickness of corrugated cardboard or chipboard to fit between said fold generating member and its respective corner defining member; and energizing means for moving said second portion and said first portion relative to each other between a first position wherein said fold generating members are located outside a plane defined by said corner defining members and a second position wherein said fold generating members are located adjacent to said corner forming surface of said corner defining members, said relative movement of said first portion and said second portion causing a corrugated cardboard or chipboard blank placed on said first portion to be folded over said corner defining members;

wherein said fold generating member comprises:

a cylinder rotatably attached to an axle, said axle having a first end and a second end; and a pair of support members, one end of one of said support members attached to said first end of said axle and one end of the other of said support members attached to said second end of said axle.

3. A triple wall corrugated cardboard carton forming machine comprising:

a stationary support frame;

a stationary portion comprising:

a plurality of corner defining members, each member having a corner forming surface; and a platform for supporting a corrugated cardboard blank, wherein said corner defining members are adjustable to adjustably define the base of the carton to be formed;

a movable portion, positioned above said stationary portion, said movable portion comprising a plurality of fold generating members, said fold generating members positionable to pass adjacent to said corner forming surface of said corner defining members at a distance sufficient to permit a thickness of triple wall corrugated cardboard to fit between said fold generating member and its respective corner defining member, said fold generating member comprising:

a cylinder rotatably attached to an axle, said axle having a first end and a second end; and a pair of support members, one end of one of said support members attached to said first end of said axle and one end of the other of said support members attached to said second end of said axle; and at least one pneumatic cylinder having a piston, said pneumatic cylinder fixedly attached to said support frame and said piston fixedly attached to said movable portion, said pneumatic cylinder for moving said movable portion in a vertical direction between a first position wherein said fold generating members are located outside a plane defined by said corner defining members and a second position wherein said fold generating members are located adjacent to said corner forming surface of said corner defining members, the movement of said movable portion over said stationary portion causing said corrugated cardboard blank placed on said stationary portion to be folded over said corner defining members.

* * * * *

UNITED STATES PATENT AND TRADEMARK OFFICE

CERTIFICATE OF CORRECTION

PATENT NO. : 5,184,998

DATED : February 9, 1993

INVENTOR(S) : Kenneth H. Volk et al

It is certified that error appears in the above-indentified patent and that said Letters Patent is hereby corrected as shown below:

On the Title Page:

In the Abstract, line 7, "generting" should read --generating--.

Signed and Sealed this

Second Day of August, 1994

*Attest:*

Bruce Lehman

BRUCE LEHMAN

*Attesting Officer*

*Commissioner of Patents and Trademarks*